US005392995A

United States Patent [19]

Wahba

[11] Patent Number: 5,392,995

[45] Date of Patent: Feb. 28, 1995

[54] FUEL INJECTOR CALIBRATION THROUGH DIRECTED LEAKAGE FLUX

[75] Inventor: Brent J. Wahba, Honeoye Falls, N.Y.

[73] Assignee: General Motors Corporation, Detroit, Mich.

[21] Appl. No.: 206,582

[22] Filed: Mar. 7, 1994

[51] Int. Cl.[6] ..... B05B 1/30; F02M 51/06

[52] U.S. Cl. ..... 239/585.4; 239/585.1; 251/129.15

[58] Field of Search ..... 239/585.4, 585.3, 585.2, 239/585.1; 251/129.15, 129.21

[56] References Cited

U.S. PATENT DOCUMENTS

| | | | |
|---|---|---|---|
| 4,463,332 | 7/1984 | Everett | 335/258 |
| 4,646,975 | 3/1987 | Horn | 239/585 |
| 4,949,904 | 8/1990 | Bata et al. | 239/5 |
| 5,044,562 | 9/1991 | Rogers et al. | 239/543 |
| 5,156,341 | 10/1992 | Terakado et al. | 239/585.4 |
| 5,158,236 | 10/1992 | Sugiyama et al. | 239/585.4 X |
| 5,232,167 | 8/1993 | McCormick et al. | 239/585.4 X |
| 5,295,627 | 3/1994 | Wahba | 239/585.4 |

FOREIGN PATENT DOCUMENTS 1328518 8/1973 United Kingdom .

*Primary Examiner*—Andres Kashnikow
*Assistant Examiner*—Lesley D. Morris
*Attorney, Agent, or Firm*—Karl F. Barr, Jr.

[57] ABSTRACT

An electromagnetic fuel injector for delivering fuel to an internal combustion engine having a solenoid energizeable by an electrical signal from a controller to establish a magnetic field operable to lift a valve member from a seat. The solenoid assembly having a tubular pole piece with an area of increased reluctance adjacent the working surface of the pole piece and an adjustment rod disposed for movement within the high reluctance region to thereby vary the location at which the high reluctance region begins. Leakage flux from the high reluctance region of the magnetic circuit may be directed to operate on a particular element of the magnetic circuit based on the location of the adjustment rod thereby allowing the leakage flux to exert a force on the element to thereby vary the dynamic response characteristics of the injector.

1 Claim, 2 Drawing Sheets

FUEL INJECTOR CALIBRATION THROUGH DIRECTED LEAKAGE FLUX

TECHNICAL FIELD

The invention relates to an electromagnetic fuel injector and, in particular, to such an injector having a variable geometry magnetic circuit for calibration of injector dynamic response.

BACKGROUND

Various types of electromagnetic fuel injectors are used in the fuel injection systems of internal combustion engines. Such injectors, as well as other solenoid controlled valve structures, incorporate a solenoid armature that is located between a center pole piece of the solenoid and a fixed valve seat whereby the armature is operable as a valve member. Examples of such electromagnetic fuel injectors or solenoid controlled valve structures are described in U.S. Pat. Nos. 4,515,129 issued May 7, 1985 to Stettner and 4,572,436 issued Feb. 25, 1986 to Stettner et al. The above identified references disclose arrangements in which an armature/valve is biased towards a normally closed position against a fixed valve seat by a spring member. Energization of the solenoid draws the armature/valve, against the bias of the closing spring, into abutment with the lower end of the solenoid center pole through attraction of the solenoid magnetic field. Following termination of the electrical signal, the solenoid magnetic field collapses and the armature/valve returns to its closed, seated position relative to the valve seat, under the bias of the return spring.

It is desirable to precisely control the flow of fuel through the valve seat, and thus the injector, in order to meet engine performance requirements. It is also desirable that, for a given application, all injectors in a particular engine meter equivalent quantities of fuel to the engine cylinders upon application of a predetermined electrical input. As such, the injector flow curve must be adjusted to meet a nominal set of injector flow requirements. In general, a solenoid operated injector is a linear device that will meter fuel on a per-pulse basis which is proportional to the input. The specific relationship between pulse-width and fuel delivered is dependent upon the static flow of the injector, which is typically controlled through armature stroke, and dynamic response or flow, which is typically a function of spring load and magnetic field characteristics.

SUMMARY OF THE INVENTION

The invention relates to an electromagnetic fuel injector for use in an internal combustion engine. The subject injector includes a housing having an axial, stepped bore with a base fixed within the bore at one end of the housing and a solenoid fixed in the bore at the other end of the housing in spaced apart relationship to the base so as to define a fuel chamber adapted to be supplied with fuel from a source. The injector base is provided with a valve seat having a fuel passage opening therethrough. Flow through the valve seat is controlled by an armature/valve member whereby axial movement of the member between the valve seat and the working surface of the solenoid assembly, upon energization of the solenoid, allows fuel to flow from the chamber through the open valve seat and out of the injector.

Armature/valve displacement or stroke, that is, the distance that the armature/valve travels between the valve seat and the working surface of the pole piece of the solenoid assembly, is a factor in setting the static fuel flow through the injector. The spring force applied to seat the armature/valve against the valve seat as well as the magnetic force generated by the energized solenoid to disengage the armature/valve from the valve seat controls the rate at which the injector opens or closes for any given pulse-width signal and therefore affects the dynamic fuel flow of the injector. Energization of the solenoid to lift the armature/valve establishes a flux field within the magnetic circuit of the injector which permeates the assembly during the energization period. Termination of the voltage applied to the injector does not necessarily result in an immediate separation of the armature from the pole piece due to delays in the collapse of the flux field and, consequently, the force acting on the armature/valve in the opening direction. Leakage flux occurs in most magnetic devices of the type described herein and is best described as flux that does not flow through the entire magnetic circuit, but rather jumps or leaks from one part of the circuit to another. Flux can not flow through regions of high reluctance in the magnetic circuit and, as a result, a portion of the flux leaks to other parts of the circuit that have a lower reluctance. A magnetic circuit does not have to be saturated to produce significant leakage flux. By adjusting the location in the magnetic circuit where the reluctance is, or transitions to, a higher value one can control the direction of the leakage flux and therefore control the element of the magnetic circuit upon which the leakage flux exerts a force.

The disclosed fuel injector advantageously utilizes the above magnetic field characteristic by limiting the center pole piece cross section or volume adjacent the working air gap. The pole piece is made with a tubular configuration and contains a moveable core or magnetic adjustment rod. As the adjustment rod is pressed closer to the tip of the center pole piece, the location in the magnetic circuit where transition occurs to a higher reluctance value also moves closer to the tip of the center pole since the flux can permeate the adjustment rod. In air, the highest proportion of flux will follow the path of least reluctance and, as a result, will leak to the nearest magnetic circuit element that completes the path. As the adjustment rod is moved towards the working surface or end of the center pole piece, the shortest path is towards the armature. This results in greater leakage flux being directed to the armature where it generates a greater holding force. Since a greater holding force takes longer to decay when the signal to the solenoid coil is discontinued, a longer closing response time results. Adjustment of the location of the center core within the reduced volume region of the pole piece provides an injector with a fine degree of dynamic flow adjustment.

These and other features, objects and advantages of this invention will be more apparent from the following Detailed Description and Drawings.

DESCRIPTION OF THE PREFERRED EMBODIMENT

Figure 1:
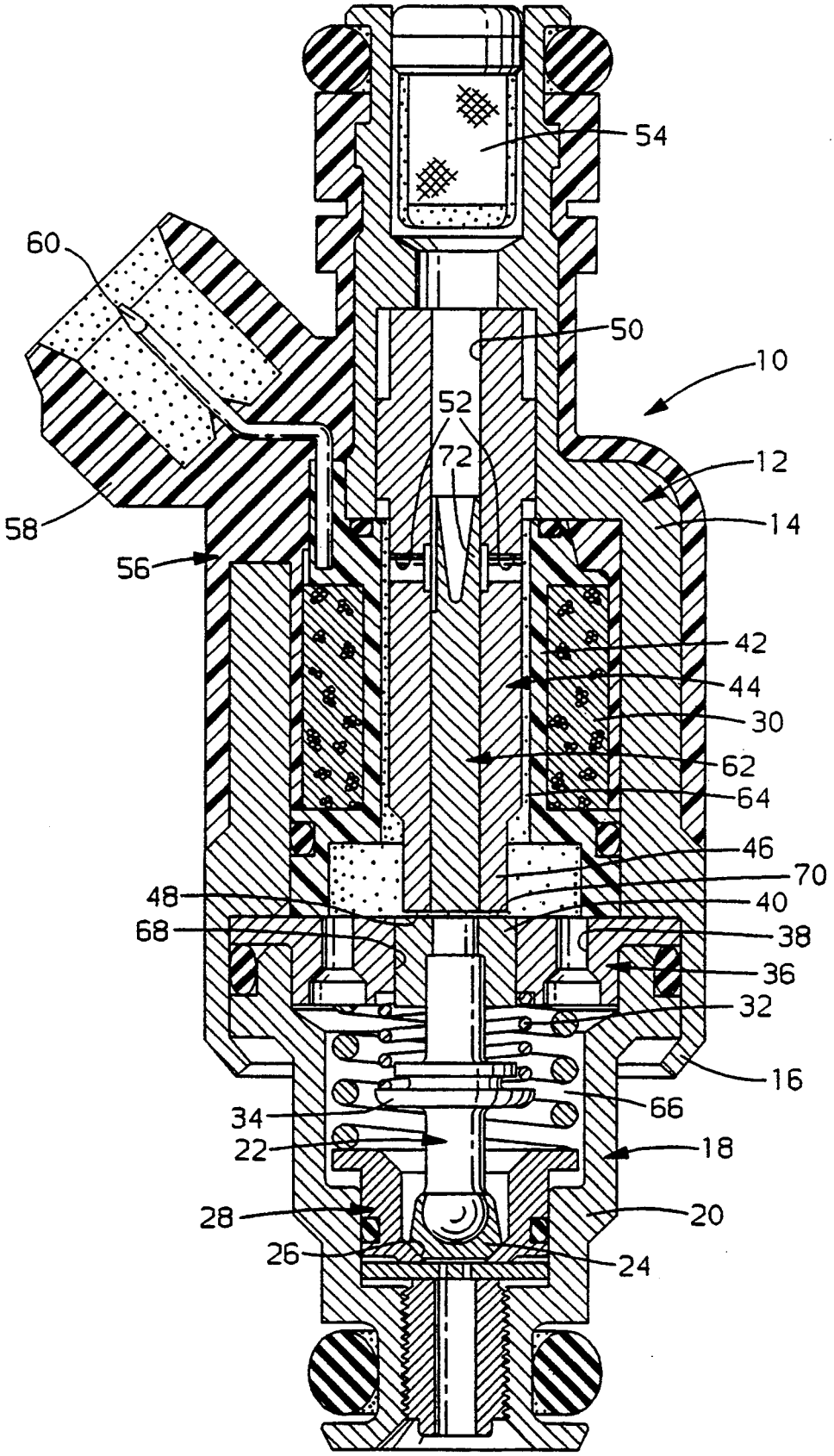
FIG. 1 is a longitudinal cross sectional view of an electromechanical fuel injector embodying features of the present invention.

FIG. 1 illustrates a fuel injector, designated generally as 10, for supplying fuel to an internal combustion engine, not shown. The injector has a solenoid assembly 12 with a generally cylindrical and stepped diameter shell 14 having a skirt portion 16 at the lower end thereof that receives the upper end of a nozzle assembly 18, which has a cylindrical stepped diameter main casing 20. The annular end of the skirt portion 16 of the shell 14 is crimped inwardly to grip the enlarged head portion of the casing to thereby fasten the nozzle assembly 18 to the lower end of the injector shell, rigidly securing the parts together.

Operatively mounted for linear movement within the nozzle casing 20, is a reciprocally moveable and elongated valve element 22 having at its lower end a semispherical core ball 24, which is adapted to be moved from a seated and fuel sealing engagement position with a cooperating valve seat 26 of valve body 28 to define a flow passage through nozzle assembly 18.

The valve element 22 is controlled in its movement by the electromagnetic force of a periodically energizeable coil 30 of solenoid assembly 12 operatively mounted in the injector shell 14 and opposing the return force of a helical return spring 32. The lower end of the spring 32 is seated on a collar 34 formed on the valve element 22 intermediate of the ends thereof while the upper end is seated on annular spacer disc or ring 36 having axial fuel feed passages 38 extending therethrough.

The cylindrical upper end of the valve element 22 is fixed within an armature 40 which strokes with radial clearance within spacer ring 36 which operates as an outer pole piece in the magnetic circuit of the solenoid assembly 12.

Valve lift occurs on energization of coil 30, the turns of which are wound on a bobbin 42 constructed of insulating polymeric material which encompasses a hollow, elongated solenoid stator that forms the center pole piece 44 of the solenoid assembly 12. The lower end of the center pole piece 44 has a region of reduced diameter 46, terminating in the working surface 48 of the pole piece. The working surface 48 contacts and limits the upward lift of the armature/valve element 40 upon energization of the coil 30. The reduction in diameter of the pole piece establishes a region with a smaller volume than adjacent regions, resulting in an area of increased reluctance in the injector magnetic circuit. During periods of solenoid energization, the reduced diameter region 46 of center pole piece 44 will produce high flux leakage due to the higher reluctance.

The center pole piece 44 has a centralized fuel flow passage 50 leading from its upper end to radial intermediate flow passages 52. Pressurized fuel is supplied to the passage 50 through a fuel filter unit 54 operatively mounted in an inlet chamber provided in the upper end of the shell 14.

As shown in FIG. 1, the shell 14 is encased within an insulating polymer material 56 which is formed with an elongated side socket 58 having a pair of electrical leads, one of which is shown at 60 that operatively connect the coil to a control source of electrical power which affects the electromagnetic operation of the fuel injector 10 by pulses fed thereto from a controller, not shown. The upper end of the injector is configured for leakage free attachment to a source of fuel in a conventional manner.

Disposed within the longitudinally extending fuel passage 50 in center pole piece 44 is a magnetic adjustment rod 62 which defines a moveable core. The rod 62 is constructed of a magnetic material such as siliconiron or the like and is configured so as to be moveable within the passage 50. The rod may be moveable by press fit as is shown in FIG. 1, or may have a threaded upper end engageable with corresponding threads in the pole piece. One or more flats extends along the body of the rod 62 to allow for movement of fuel through passage 50 to radial flow passages 52. The lower end of the adjusting rod 62 is positioned for movement within the region of reduced volume and increased reluctance 46 adjacent the working end 48 of the pole piece 44.

Energization of the solenoid assembly 12 moves the armature 40 upwardly, as viewed in FIG. 1, and against the working surface 48. In the open position, pressurized fuel flows through the filter unit 54 and the pole piece 44 via the central and radial passages 50,52, respectively. From the radial passages 52 fuel flows through annular passage 64 surrounding the lower portion of the center pole piece and through axial passages 38 in the outer pole piece 36 to fuel chamber 66 where it is discharged through the open valve seat 26.

Figure 3:
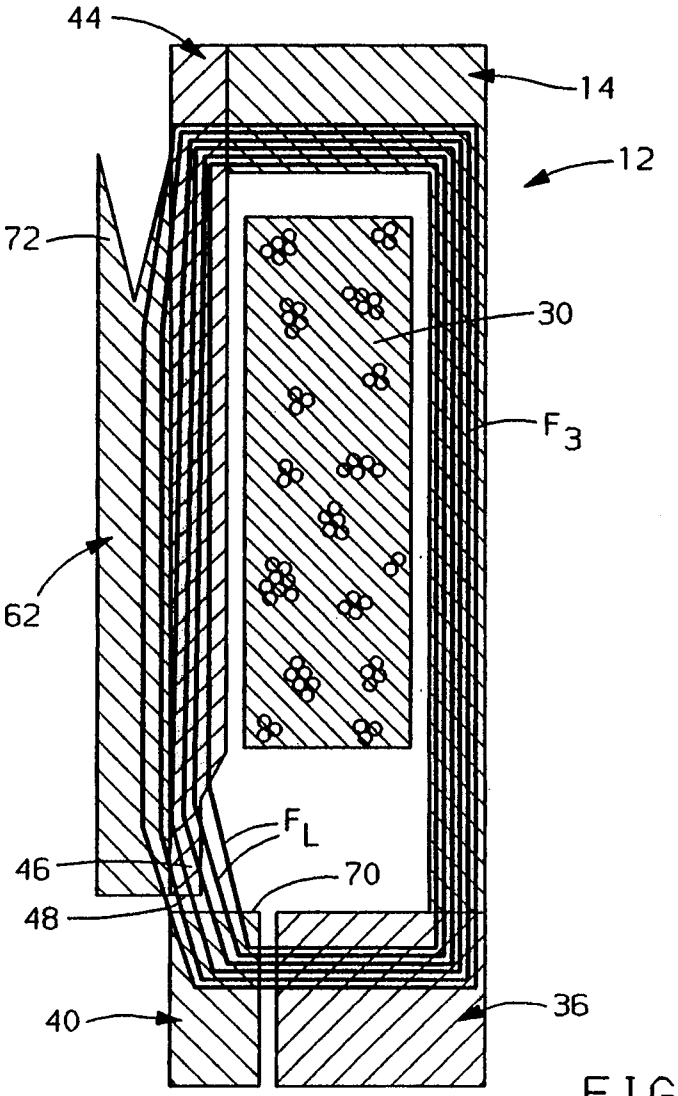
FIGS. 2 and 3 are schematic views of a portion of the magnetic circuit of the fuel injector of FIG. 1, in various modes of adjustment.
Figure 2:
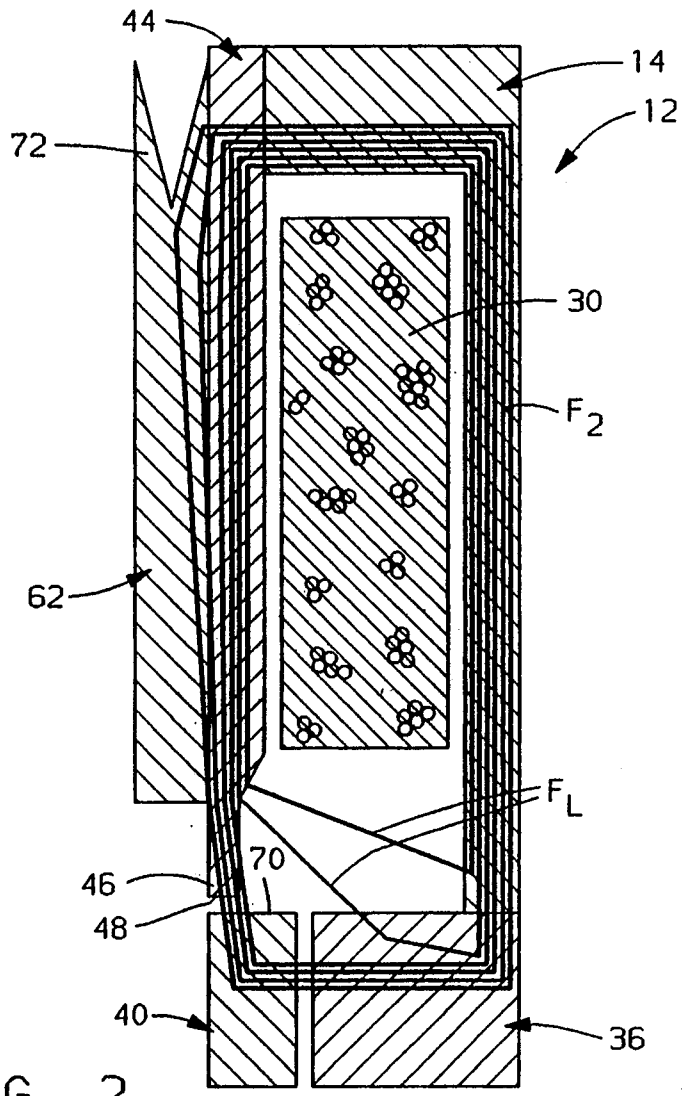

Referring now to FIGS. 2 and 3, which schematically illustrate a portion of the magnetic circuit of the present injector, flux field lines $F_2$ and $F_3$ are shown to illustrate the magnetic field in the injector upon energization by an electrical pulse. Field flux which jumps or leaks from one part of the magnetic circuit to another without following the circuit path is represented as leakage flux $F_L$. In air, the highest proportion of leakage flux will follow the path of least reluctance and, as such, will leak to the nearest magnetic circuit element that completes its path. Because leakage flux is increased near regions of high reluctance, such as the reduced volume area 46 of center pole piece 44, the magnetic circuit element to which the flux leaks or jumps can be chosen or controlled by adjusting the point where the magnetic circuit transitions to high reluctance. By controlling the magnetic circuit element to which leakage flux is directed, one can therefore control the element upon which the leakage flux $F_L$ exerts a force. In FIG. 2, if the tip of the movable center core 62 of the tubular pole piece 44 is maintained at the upper end, as viewed in the figures, of the high reluctance reduced diameter region 46, the leakage flux is directed away from the armature 40, to other elements of the magnetic circuit such as ring pole piece 36, and therefore no additional force is exerted on armature 40 and the closing response time of the valve is not affected. As the adjustment rod 62 is moved towards the working surface 48 of the center pole piece 44, as is illustrated in FIG. 3, the location in the magnetic circuit at which the transition to higher reluctance begins, is moved closer to the working surface 48 of the pole piece. This occurs because the flux field can permeate the adjustment rod and, as such, the transition point to a reduced cross sectional area in the magnetic circuit at which the reluctance increases is displaced towards the area of the pole piece adjacent the working surface 48. As the adjustment rod 62 is moved towards the working surface 48 of the pole piece 44 the shortest path, or path of least reluctance for the leakage flux $F_L$ is towards the armature 40, rather than the ring pole 36, resulting in the leakage flux being directed to the armature, FIG. 3, where it generates a greater holding force. The distance from the point of transition to high reluctance in the pole piece to the face of the armature must be less than the distance to any other magnetic circuit element when the adjusting rod is in the position to provide the maximum closing response time.

The injector described herein, utilizes an armature 40 configured to operate within a circumjacently disposed opening 68 within outer pole piece 36 to thereby position the armature such that when the adjusting rod 62 is driven to a point adjacent the center pole piece working surface 48, the path of least resistance for the leakage flux will be through the armature 40 rather than through the ring pole piece 36. To enhance the targeting of the leakage flux $F_L$ relative to the armature 40, the surface area of the working surface 70 of the armature 40 must be greater than that of the working surface 48 of center pole piece 44, since the flux must operate normal to the armature working surface to effect a force variation on the armature. The greater holding force generated by the increased flux field passing through the armature increases the time for decay of the magnetic field when the electrical current to the coil 30 is terminated. The result is an increase in closing time for the injector 10.

Since the leakage flux $F_L$ generated by the magnetic circuit of the injector 10 is significant only after the injector has opened, and the working air gap has closed resulting in a high flux level, the opening response and minimum operating voltage of the injector is not affected by adjustment of the type described. Control of the leakage flux $F_L$ allows for fine adjustment of the closing response time of the injector which is important in that most dynamic flow variation is due to closing response variation.

As the adjustment rod 62 is moved towards the working surface 48 of the center pole piece 44, the volume of the high reluctance region 46 is reduced and the overall magnetic circuit reluctance is subject to variation. It may be desirable to adjust the magnetic circuit to compensate for changes to overall magnetic circuit reluctance brought about by this movement of the adjustment rod 62. A tapered portion 72 may be added to the upper end of the adjusting rod 62, as viewed in the figures, which will reduce the volume of material elsewhere in the circuit thereby raising the reluctance in the region of the taper to balance the change in reluctance at the working end of the rod.

The present invention discloses an electromechanical fuel injector for use in an internal combustion engine having a tubular center pole piece with a high reluctance region and an adjustable center rod for moving the location of the high reluctance region relative to the working surface of the pole piece. Adjustment of the high reluctance region provides for control of the direction of leakage flux within the magnetic circuit and thereby allows the strength of the magnetic field which is operable on the armature to be varied. Varying the field strength affects the time required for the fields to collapse following cessation of current to the solenoid thereby varying the closing response time to the injector.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described were chosen to provide an illustration of the principles of the invention and its practical application to thereby enable one of ordinary skill in the art to utilize the invention in various embodiments and with various modifications as are suited to the particular use contemplated. Therefore, the foregoing description is considered exemplary, rather than limiting, and the true scope of the invention is that described in the following claims.

The embodiments of the invention in which an exclusive property or privilege is claimed are defined as follows:

1. An electromagnetic fuel injector having a valve member moveable between opened and closed positions with respect to a valve seat to establish fuel flow through said injector, a valve actuator comprising a solenoid assembly having a tubular center pole piece, an armature in operable communication with said valve member, said center pole piece and said armature having opposed working surfaces, and an annular outer pole piece circumjacently disposed about said armature, said center pole piece, said armature and said outer pole piece defining a magnetic circuit operable upon energization by an electrical signal, to cause said armature and associated valve member to move to said opened position and upon deenergization to move to said closed position, said center pole piece comprising a region of high reluctance adjacent to its working surface and a magnetically permeable adjustment rod disposed therein, said adjustment rod having a first end situated for movement within said region of high reluctance to thereby vary the location, relative to the working surface of said armature, at which said high reluctance region begins and operable to control the direction of flux leakage from said magnetic circuit so as to control the element of said magnetic circuit upon which leakage flux exerts a force.

* * * * *